US005447293A

United States Patent [19]

Clarke et al.

[11] Patent Number: 5,447,293

[45] Date of Patent: Sep. 5, 1995

[54] METHOD AND APPARATUS FOR QUENCHING HEAT TREATED OBJECTS

[76] Inventors: Beresford N. Clarke; John B. Clarke, both of 3723 W. Hamilton Rd., Fort Wayne, Ind. 46804; Hans E. Mobius, Michael-Tritz-Str. 4, D 6633 Wadgassen, Germany

[21] Appl. No.: 279,047

[22] Filed: Jul. 22, 1994

[51] Int. Cl.[6] ..... C21D 1/66

[52] U.S. Cl. ..... 266/46; 266/114; 266/116

[58] Field of Search ..... 266/46, 114, 116

[56] References Cited

U.S. PATENT DOCUMENTS

| | | | |
|---|---|---|---|
| 3,531,096 | 9/1970 | Krach et al. | 266/133 |
| 3,684,263 | 8/1972 | Genrich | 148/153 |
| 4,308,881 | 1/1982 | Bertolotti | 266/114 |
| 4,375,820 | 3/1983 | Vinaresik | 266/114 |
| 4,486,009 | 12/1984 | Kopf | 266/114 |
| 4,487,398 | 12/1984 | Lincoln et al. | 266/120 |
| 4,504,042 | 3/1985 | Kruppert | 266/121 |
| 4,629,165 | 12/1986 | Rothe | 266/114 |
| 4,632,297 | 12/1986 | Hermann | 266/46 |

FOREIGN PATENT DOCUMENTS

| | | |
|---|---|---|
| 1305290 | 11/1961 | France . |
| 726135 | 10/1942 | Germany . |
| 49-3887 | 1/1974 | Japan . |
| 1154346A | 7/1985 | U.S.S.R. . |

*Primary Examiner*—Peter D. Rosenberg
*Attorney, Agent, or Firm*—Barnes & Thornburg

[57] ABSTRACT

A quench chute for use in heat treating objects extends from one end of a furnace into a tank filled with quenching fluid. The chute has a passage therein through which heat treated objects fall from the furnace into the tank. Laminar sheets of quenching fluid are introduced into the chute above the quenching fluid level in the tank and a portion of the chute is constructed from a screen which allows quenching fluid to exit the chute and return to the quench tank. A portion of the chute below the quenching fluid level is curved and has a plurality of fluid manifolds disposed therealong for introducing high pressure jets of fluid into the chute. As the objects fall from the furnace into the chute, they first pass through the laminar sheets of quenching fluid. The objects then fall through the quenching fluid and glance off of the curved portion of the chute. The objects are decelerated by the glancing contact with the chute and by the jets of quenching fluid introduced into the chute by the manifold. The parts are ultimately deposited on a conveyor in the tank. The parts land on the conveyor at an angle substantially parallel thereto. Damaging direct impact of hot ductile parts with conveying components and with each other is replaced by low velocity fluid-cushioned glancing impacts to reduce part damage and mixing.

34 Claims, 4 Drawing Sheets

METHOD AND APPARATUS FOR QUENCHING HEAT TREATED OBJECTS

BACKGROUND AND SUMMARY OF THE INVENTION

The present invention relates to a method and apparatus for quenching heat treated objects, and, more particularly, to an improved quench chute for conveying objects from a furnace into a tank of quenching fluid.

Numerous objects, including nuts, bolts, bearings and other small parts, are subjected to heat treating processes in order to obtain certain physical properties. Typically, the objects are heated to a desired temperature (or cycled through a series of desired temperatures) while being exposed to a predetermined atmosphere. The parts are then typically subjected to a rapid cooling process, usually by submerging the parts in a quenching fluid such as water, oil or hot salt.

In practice, parts are typically loaded onto a conveyor passing through a furnace. As the parts travel through the furnace, they are heated to the desired temperature, or cycled through several temperatures. At the end of the furnace, the parts fall from the conveyor through a chute and into a tank of quenching fluid. At the bottom of the chute, the parts fall onto another conveyor, which removes them from the tank of quenching fluid.

Although the foregoing method has been found suitable for cooling heat treated parts, it has also been found that the parts may be damaged in the process. Specifically, many parts are still red hot and in a ductile condition as they fall through the quenching fluid, and may remain red hot even after they reach the top of the removal conveyor. These ductile parts may pile up at the bottom of the chute and be repeatedly struck by other falling parts. If this occurs, nicks, flattening of surfaces and mashing of threads on bolts or similar items, can occur. Such damage can result in numerous problems when the parts are shipped to an end user for use on a production line. This is particularly true if the parts will be fed into an automated assembly system via a magazine.

To compensate for the foregoing problem, several quench chutes have been produced with a series of angled baffles disposed therein. In practice, the parts strike the first baffle and are directed to the next one. This repeated striking of baffles slows the parts before they reach the bottom of the chute and strike other parts. However, it has been found that as much damage can occur from the parts striking the angled baffles as from the parts merely falling on each other. Additionally, the system of baffles does not prevent the parts from ultimately landing one on top of the other at the bottom of the chute. Furthermore, parts may become lodged on the baffles and not be dislodged until a different type of part is processed, thus resulting in mixing of parts.

Accordingly, it is an object of the present invention to provide an improved system for quenching heat treated objects.

Another object of the present invention is the provision of a system for quenching heat treated objects which will prevent damage from occurring to the objects.

Yet another object of the present invention is the provision of a system for quenching heat treated objects that prevents objects from becoming mixed with dissimilar objects in a tank of quenching fluid.

These and other objects of the present invention are attained by the provision of an improved apparatus for cooling heat treated objects. The apparatus includes a tank for holding quenching fluid, removal means for directing the objects to be cooled into the fluid, means for removing the objects from the fluid and means for directing the objects onto the removal means at an angle substantially parallel to an object-conveying surface of the removal means. The means for directing the objects into the fluid includes a chute having a curved portion that terminates in an end substantially parallel to an object-conveying surface of the removal means. The curved portion is positioned such that the objects glance off of the curved portion as they fall through the fluid. The apparatus further includes fluid manifolds having outlets that direct fluid into the chute along the length and width of the curved portion. The fluid directed into the chute decelerates the objects as they glance off of the curved portion. One dimension of the chute is constant along the entire length thereof. The removal means includes a conveyor disposed within the tank. A screen is disposed over the removal conveyor to prevent the objects from being blown off of the surface of the conveyor by the force of the final cooling sprays.

Other objects, advantages and novel features of present invention will become apparent when considering the following detailed description of embodiments in conjunction with the accompanying drawings.

DETAILED DESCRIPTION OF THE PREFERRED EMBODIMENTS

Figure 1:
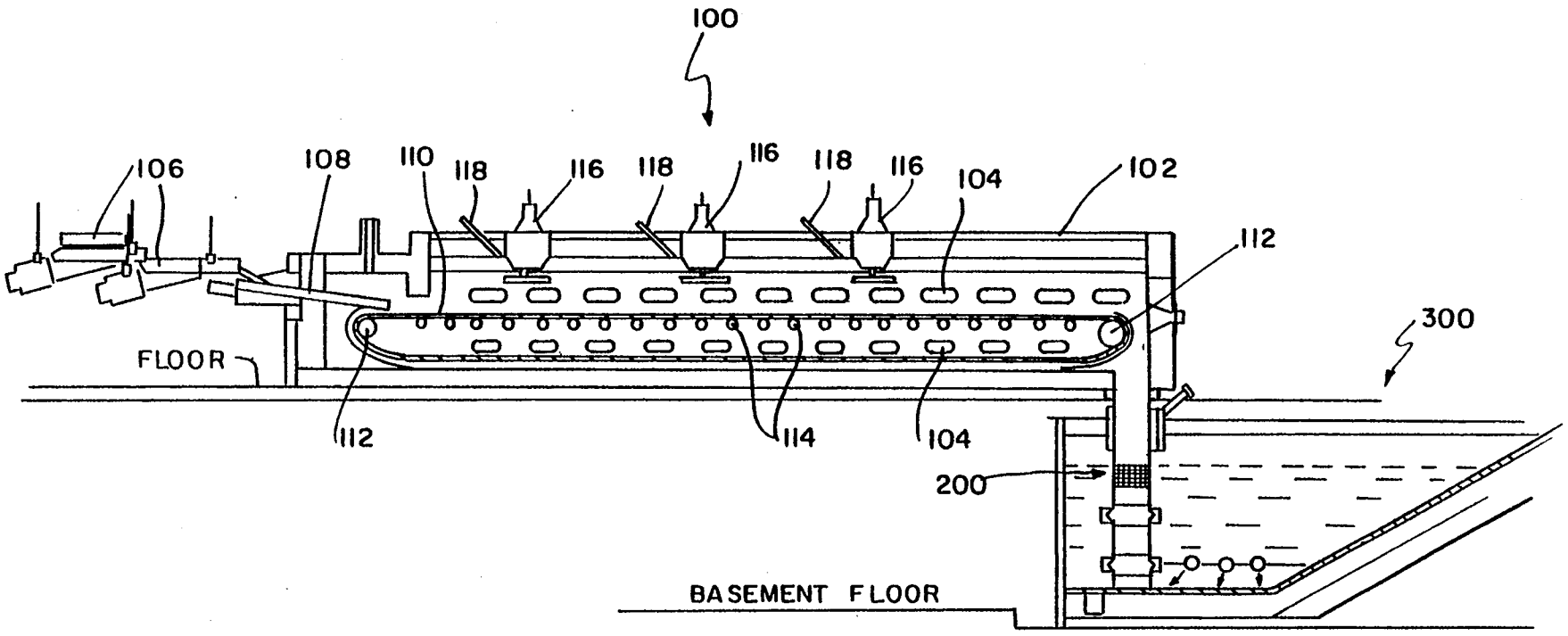
PRIOR ART FIG. 1
FIG. 1 shows a prior art furnace, quench chute, and quench tank for use in heat treating small objects.

FIG. 1 shows a prior art furnace and quench tank for heat treating objects such as nuts, bolts, ball joints, bearings, ratchet parts, automotive parts and numerous other items. The apparatus consists primarily of furnace 100, quench chute 200, and quench tank 300. Quench tank 300 may be supported on a basement floor below furnace 100. Quench chute 200 extends from furnace 100 to quench tank 300.

Furnace 100 includes an enclosure 102 having heating elements 104 disposed therein. A loading apparatus 106 directs objects to be heat treated along chute 108 and onto conveyor 110 in enclosure 102. Conveyor 110 is supported at each end by a rotating drum 112. Rollers 114 are disposed between rotating drums 112 and further assist support and movement of conveyor 110. A plurality of fans 116 extend into enclosure 102 and circulate the air and/or gases present within enclosure 102 during the heat treating process. A plurality of atmosphere inlets 118 are also included in furnace 100. Inlets 118 may be used to introduce desired gases into enclosure 102 during the heat treating process.

Figure 2:
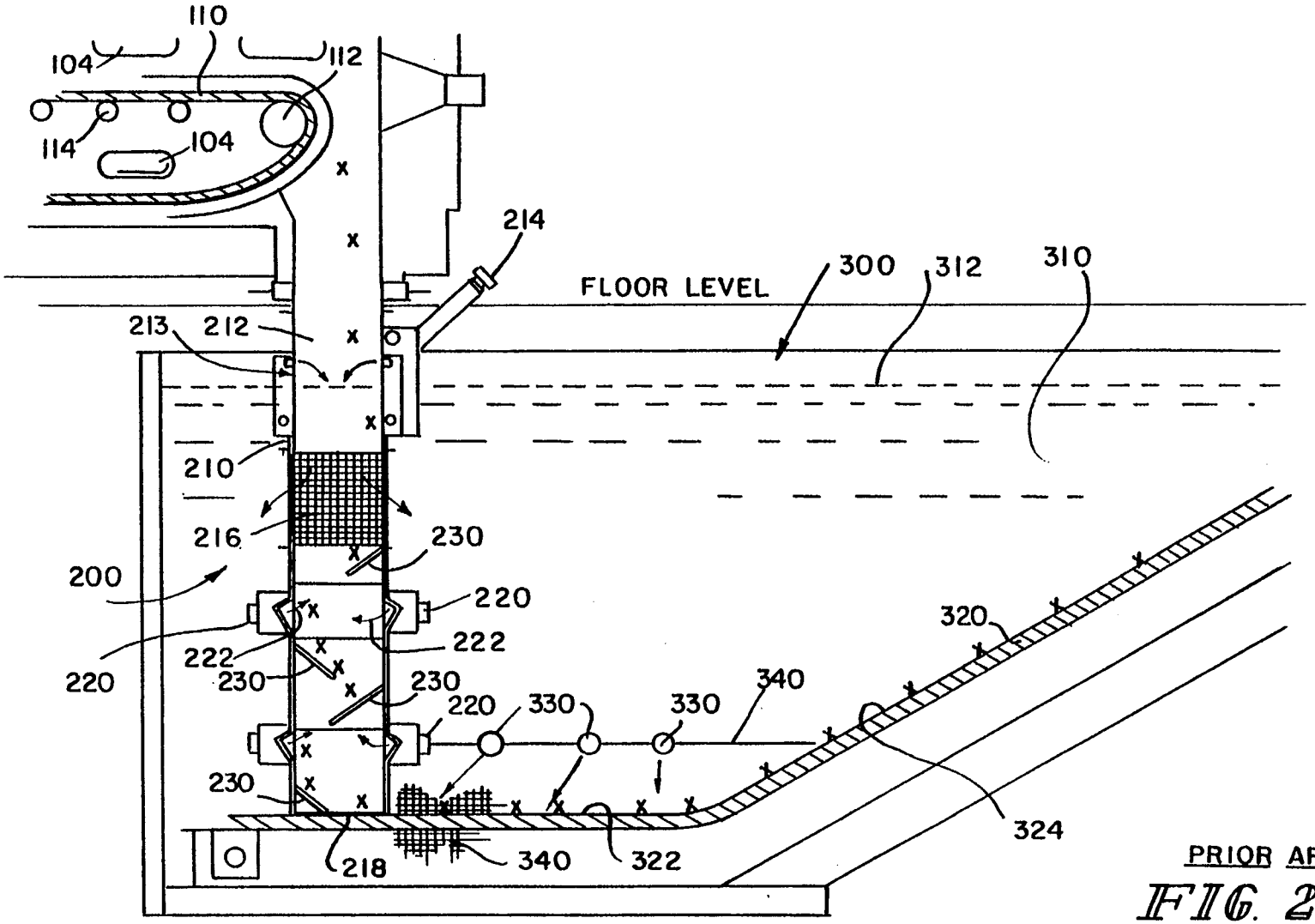
PRIOR ART FIG. 2
FIG. 2 shows a detailed view of the prior art quench chute and quench tank shown in FIG. 1.

FIG. 2 shows a detailed view of quench chute 200 and quench tank 300. Quench chute 200 includes an enclosure 210 with a passage 212 running therethrough. Laminar flat sheets of quenching fluid are introduced into passage 212 at point 213, just above the quenching fluid level in enclosure 210. These sheets of fluid condense quenching fluid vapor and droplets which splash when the objects are quenched, as described below. A vapor outlet 214 communicates with passage 212 to allow uncondensed vapor to exit passage 212. Enclosure 210 further includes a screen 216 forming a portion thereof below the quenching fluid level in tank 300, described below. Screen 216 allows quenching fluid to circulate out of enclosure 210 and back into tank 300. Enclosure 210 terminates at end 218. A plurality of quenching fluid manifolds 220 terminate in outlets 222. Outlets 222 communicate with passage 212 and introduce a flow of fluid therein. A plurality of angled baffles 230 are disposed within enclosure 210.

Quench tank 300 is filled with quenching fluid 310 to a level 312. The quenching fluid utilized may be one of a variety of materials, such as oil, water, or hot salt. If oil is used, the temperature is typically 135°–180° F. If the quenching fluid is water, the temperature is typically 70°–130° F. If hot salt is used, the temperature is typically 400°–700° F. A conveyor 320 is disposed in quench tank 300. Conveyor 320 has a first object-conveying surface 322 and a second object-conveying surface 324. First surface 322 is substantially parallel to the bottom of quench tank 300. Quenching fluid manifolds 330 direct high velocity sprays of quenching fluid toward conveyor 320. A screen 340 is disposed in tank 300 above and around conveyor 320. This screen is made of nonmagnetic material if conveyor 320 is a magnetic conveyor and of steel if conveyor 320 is a mechanical conveyor. This screen confines the parts to conveyor 320 in the area where they are subjected to high velocity sprays of quenching fluid from manifolds 330 which might otherwise wash small parts off the surface of conveyor 320.

In operation, the parts to be heat treated, one of which is indicated by the letter "X", pass through furnace 100 on conveyor 110 and fall from conveyor 110 into passageway 212 of chute 200. As the parts fall, they first pass through the laminar sheets of quenching fluid at 213 and into quenching fluid 310. They then proceed through passage 212, strike the first baffle 230, and are deflected toward the second baffle 230 and so on until they reach the bottom of chute 200 at end 218 and land on first object-conveying surface 322. From there, the parts are carried out of quench tank 300 by conveyor 320. As the parts are carried on conveyor 320, they are further cooled by jets of quenching fluid directed toward conveyor 320 by manifolds 330. Screen 340 contains the parts on conveyor 320 and prevents them from being dispersed throughout tank 300.

Although the above-described prior art system adequately cools the heat treated parts, it contributes to the problems previously discussed. As described above, baffles 230 are placed in passage 212 such that the falling parts strike the baffles to slow their descent. The falling parts are often damaged by striking baffles 230. Additionally, the parts may pile up on first object-conveying surface 322 of conveyor 320 at end 218 of chute 200. If this happens, additional damage may occur from falling parts striking the parts on conveyor 320.

Figure 3:
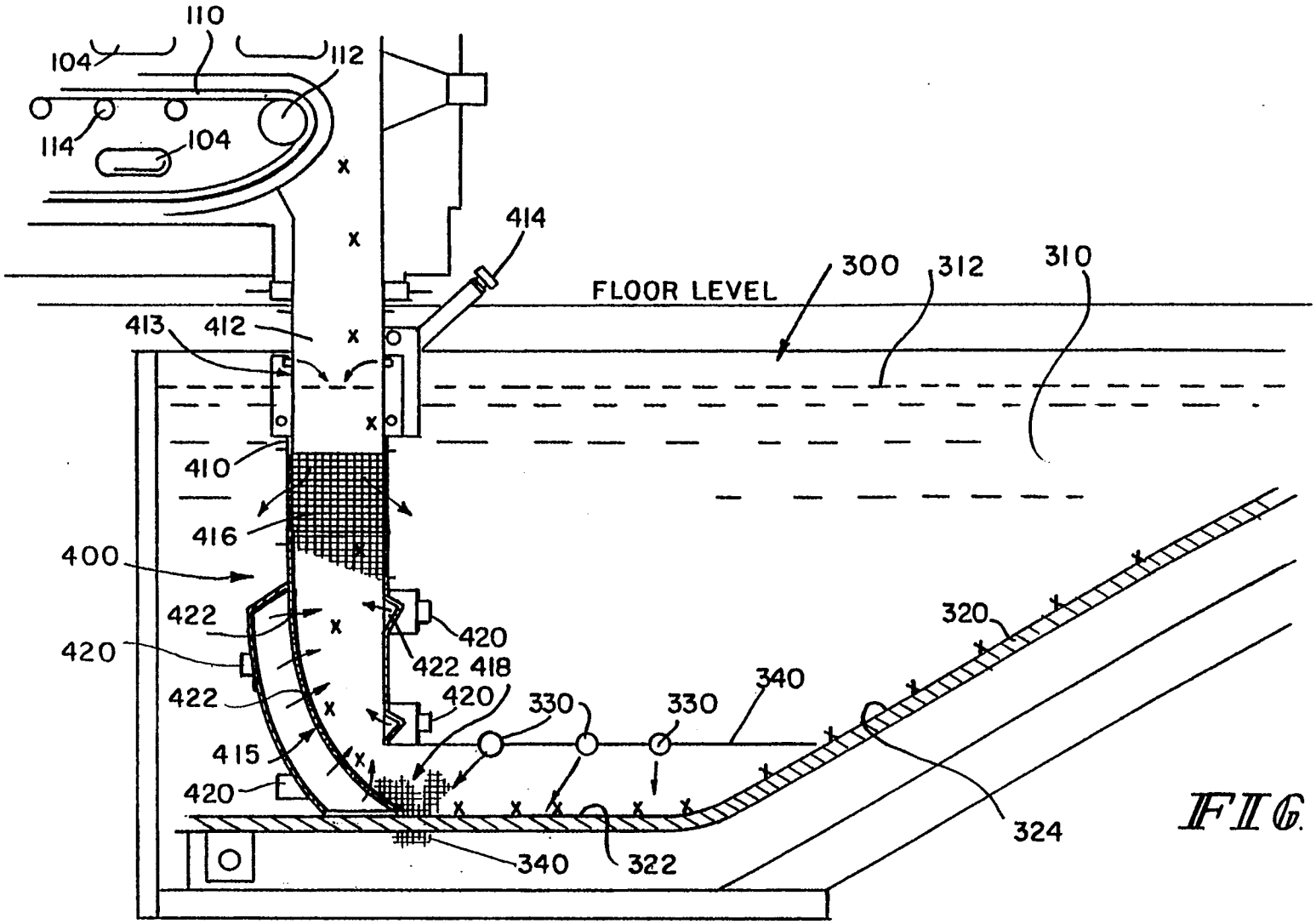
FIG. 3 shows a detailed view of the quench chute and quench tank of the present invention.
Figure 4:
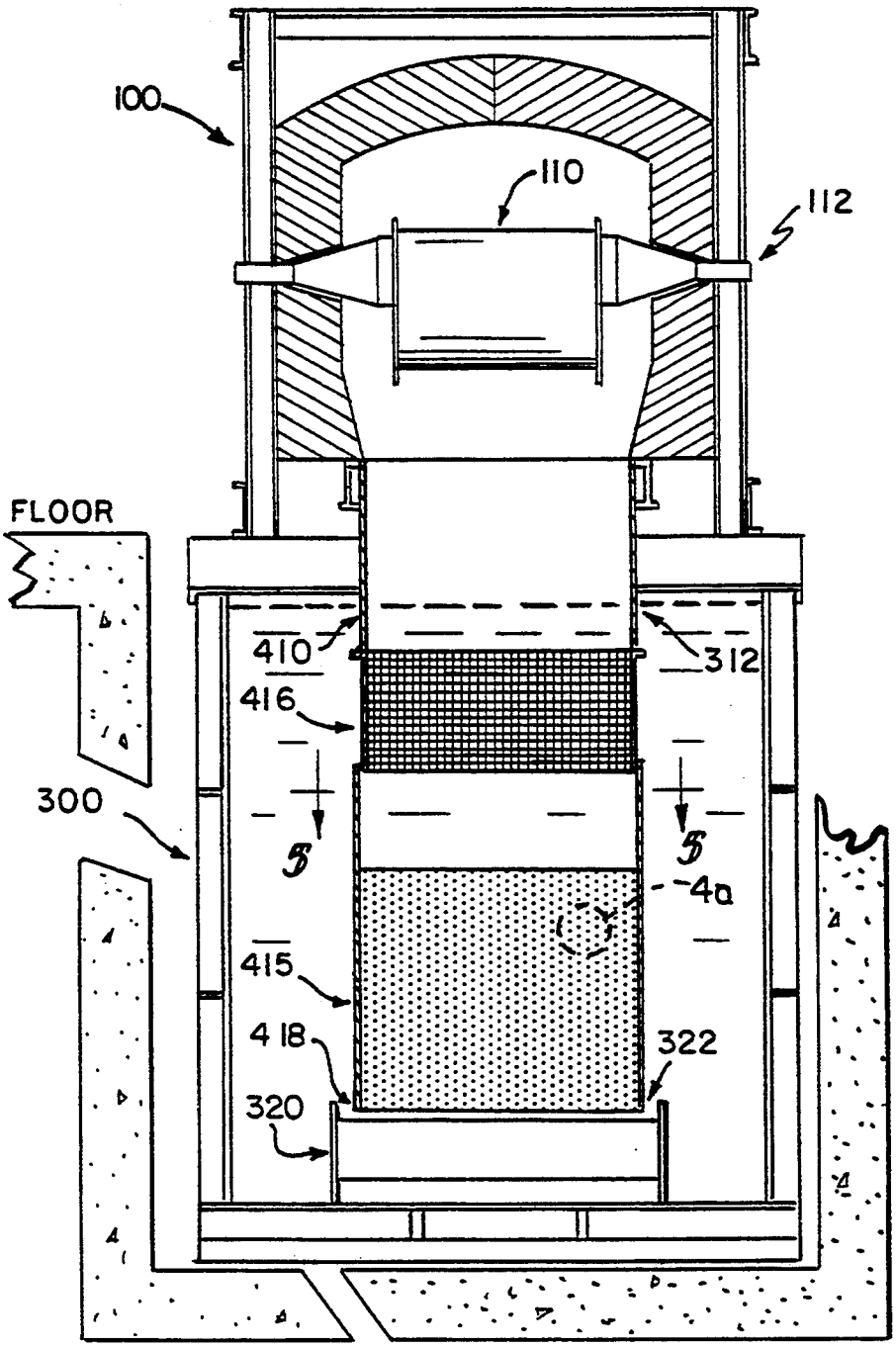
FIG. 4 is a partial cut-away, front plan view of the quench chute shown in FIG. 3.
Figure 4A:
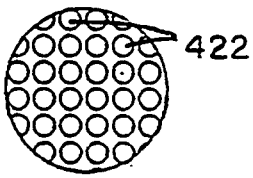
FIG. 4*a* ia an enlarged view of outlets 422 shown in FIG. 4.
Figure 5:
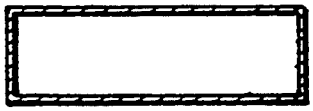
FIG. 5 is a cross-sectional view taken along line 5—5 in FIG. 4.

The improved quench chute of the present invention, shown in FIG. 3, is designed to reduce the foregoing problems. In FIG. 3, the numeral "4" has been used in place of the numeral "2" in front of the remainder of the designations to indicate corresponding parts with the embodiment shown in FIG. 2. Thus, chute 400 includes enclosure 410 having passage 412 therein. Laminar sheets of quenching fluid are introduced into passage 412 above fluid level 312 at location 413. A vapor outlet 414 communicates with passage 412. Screen 416 forms a part of enclosure 410 of chute 400. Below screen 416, enclosure 410 transitions to a curved portion 415, terminating at end 418. The curvature of portion 415 is such that end 418 terminates enclosure 410 substantially parallel to first object-conveying surface 322 of conveyor 320. A plurality of fluid manifolds 420 are disposed along enclosure 410, and in particular, along curved portion 415. Fluid manifolds 420 terminate in outlets 422 (FIG. 4*a*), which communicate with passage 412. As shown in FIG. 4, outlets 422 are disposed along the entire width and length of curved portion 415. Thus, a flow of quenching fluid is directed into passage 412 along the entire length and width of curved portion 415. Note that each outlet 422 is disposed along curved portion 415 so as to direct fluid into passage 412 along a line perpendicular to a line tangent to curved portion 415 at the particular outlet 422.

FIG. 4 shows that enclosure 412 is wider than conveyor 110. It also shows that conveyor 320 is wider than enclosure 412. This progressive widening of the passageways ensures that the parts do not strike on the lateral sides of enclosure 412 and also that they fall on conveyor 320. Screen 340 is the full width of conveyor 320 to ensure confining the parts to the conveyor surface 322 while not impeding their passage. As a result, quench chute 400 does not produce a funneling effect by which all parts being quenched are guided toward a central part of the chute, as is found in prior art systems. Thus, damage resulting from the objects being quenched backing up in a constricted portion of the quench chute is greatly reduced.

In operation, the objects to be cooled fall from conveyor 110 and pass through laminar sheets of quenching fluid at 413 and into quenching fluid 310. As they fall further toward end 418 of chute 400, the objects strike curved portion 415 at a glancing angle and slide down to first object-conveying surface 322 of conveyor 320. Because the numerous outlets 422 disposed along curved portion 415 inject high pressure streams of fluid at the falling parts, the parts are cushioned as they strike curved portion 415. Additionally, because portion 415 is curved inward toward the center of passage 412, the parts strike only a glancing blow against portion 415. That is, the falling parts strike curved portion 415 at an oblique angle. The direct impact of prior art designs has been replaced with glancing contacts cushioned by a fluid film from high velocity fluid jets. Thus, damage to the falling parts is reduced to a great degree. Additionally, as noted above, the curvature of portion 415 is such that end 418 terminates chute 400 substantially parallel to first object-conveying surface 322 of conveyor 320. As a result, the parts do not pile up on conveyor 320, but rather slide onto conveyor 320 in a continuous stream. Thus, damage resulting from falling parts striking a pile of parts on conveyor 320 is reduced.

Although the above invention has been described in detail, the same is to be taken as illustration only, and not by way of limitation. It will now be readily apparent to those skilled in the art that several embodiments may be made without departing from the scope and spirit of the invention. For example, conveyor 320 may be a traditional mechanical conveyor type, a preferred magnetic type, or other type. Additionally, the loading mechanism of furnace 100, as well as conveyor 110 disposed therein, may also take several standard configurations known in the art. Accordingly, the spirit and scope of the invention is to be limited only by the claims appended hereto.

We claim:

1. Apparatus for cooling heat treated objects, comprising:

a tank for holding a quenching fluid;

means for directing the objects to be cooled into the fluid, said means extending from above the fluid into the fluid;

removal means for removing the objects from the fluid; and means for directing the objects onto the removal means at an angle which is substantially parallel to an object-conveying surface of said removal means.

2. The apparatus according to claim 1, wherein said removal means includes a conveyor.

3. The apparatus according to claim 2, wherein said conveyor includes magnetic means for attracting the objects thereto.

4. The apparatus according to claim 2, further including a screen disposed near said conveyor and positioned so as to prevent the objects from falling off said conveyor.

5. The apparatus according to claim 1, wherein said means for directing the objects into the fluid and onto said removal means includes a chute.

6. The apparatus according to claim 5, wherein said cute includes a curved portion disposed in the tank adjacent the removal means.

7. The apparatus according to claim 6, wherein said curved portion is positioned such that the objects glance off of said curved portion as they move through the fluid.

8. The apparatus according to claim 7, further including means for decelerating the objects as they glance off of said curved portion.

9. The apparatus according to claim 8, wherein said means for decelerating the objects includes a plurality of fluid manifolds having outlets that direct fluid into said chute.

10. The apparatus according to claim 9, wherein said outlets are disposed along said curved portion so as to direct fluid into said chute at substantially perpendicular angles to lines tangent to said curved portion.

11. The apparatus according to claim 10, wherein said outlets are spaced both vertically and horizontally across said curved portion.

12. The apparatus according to claim 5, wherein at least one dimension of said chute remains constant along substantially the entire length of said chute.

13. Apparatus for cooling heat treated objects, comprising:

a tank for holding a quenching fluid;

a conveyor for removing the objects from the fluid; and a chute for directing the objects through the fluid and to said conveyor, said chute configured so as to introduce the objects onto said conveyor at an angle which is substantially parallel to an object-conveying surface thereof.

14. The apparatus according to claim 13, wherein said conveyor includes magnetic means for attracting the objects to said conveyor.

15. The apparatus according to claim 13, further including a screen disposed near said conveyor and positioned so as to prevent the objects from falling off said conveyor.

16. The apparatus according to claim 13, wherein said chute includes a curved portion positioned such that the objects glance off of said curved portion as they move through the fluid.

17. The apparatus according to claim 16, further including means for decelerating the objects as they glance off of said curved portion.

18. The apparatus according to claim 17, wherein said means for decelerating the objects includes a plurality of fluid manifolds having outlets that direct fluid into said chute.

19. The apparatus according to claim 18, wherein said outlets are disposed along said curved portion so as to direct fluid into said chute at substantially perpendicular angles to lines tangent to said curved portion.

20. The apparatus according to claim 19, wherein said outlets are spaced both vertically and horizontally across said curved portion.

21. The apparatus according to claim 13, wherein at least one dimension of said chute remains constant along substantially the entire length of said chute.

22. Apparatus for cooling heat treated objects, comprising:

a tank for holding a quenching fluid;

means for directing the objects to be cooled into the fluid;

removal means for removing the objects from the fluid; and wherein said directing means includes a chute having an elongated portion having a first end above the fluid, a second end extending into the fluid, and a curved portion disposed adjacent said second end and positioned such that the objects glance off of said curved portion as they pass through said chute.

23. The apparatus according to claim 22, wherein the objects exit said curved portion substantially perpendicular to said elongated portion.

24. The apparatus according to claim 22, further including means for decelerating the objects as they glance off of said curved portion.

25. The apparatus according to claim 24, wherein said means for decelerating the objects includes a plurality of fluid manifolds having outlets that direct fluid into said chute.

26. The apparatus according to claim 25, wherein said outlets are disposed along said curved portion so as to direct fluid into said chute at substantially perpendicular angles to lines tangent to said curved portion.

27. The apparatus according to claim 26, wherein said outlets are spaced both vertically and horizontally across said curved portion.

28. The apparatus according to claim 22, wherein at least one dimension of said chute remains constant along substantially the entire length of said chute.

29. An apparatus for cooling heat treated objects, comprising:

a chute for directing the objects into a tank of quenching fluid, said chute having a first end for receiving the objects disposed at one end of a heat treating apparatus and a second end submerged in a tank of quenching fluid, said chute including a curved portion positioned such that the objects glance off of said curved portion as they fall through said chute into the fluid; and a conveyor for removing the objects from said tank, said conveyor positioned with respect to said chute such that said objects land on said conveyor at an angle substantially parallel to said conveyor.

30. The apparatus according to claim 29, further including means for decelerating the objects as they glance off of said curved portion.

31. The apparatus according to claim 30, wherein said means for decelerating the objects includes a plurality of fluid manifolds having outlets that direct fluid into said chute.

32. The apparatus according to claim 31, wherein said outlets are disposed along said curved portion so as to direct fluid into said chute at substantially perpendicular angles to lines tangent to said curved portion.

33. The apparatus according to claim 32, wherein said outlets are spaced both vertically and horizontally across said curved portion.

34. The apparatus according to claim 29, wherein at least one dimension of said chute remains constant along substantially the entire length of said chute.

* * * * *